US006990958B2

(12) United States Patent
Asano et al.

(10) Patent No.: US 6,990,958 B2
(45) Date of Patent: Jan. 31, 2006

(54) INJECTION CONTROL SYSTEM OF DIESEL ENGINE

(75) Inventors: Masahiro Asano, Kariya (JP); Eiji Takemoto, Obu (JP); Hiroshi Haraguchi, Kariya (JP)

(73) Assignee: Denso Corporation, Kariya (JP)

( * ) Notice: Subject to any disclaimer, the term of this patent is extended or adjusted under 35 U.S.C. 154(b) by 36 days.

(21) Appl. No.: 10/980,800

(22) Filed: Nov. 4, 2004

(65) Prior Publication Data

US 2005/0098158 A1 May 12, 2005

(30) Foreign Application Priority Data

Nov. 7, 2003 (JP) ..... 2003-378664

(51) Int. Cl.
*F02D 41/40* (2006.01)

(52) U.S. Cl. ..... 123/436; 123/458; 123/480

(58) Field of Classification Search ..... 123/436, 123/446, 447, 457, 458, 480, 674, 675; 701/104, 701/110

See application file for complete search history.

(56) References Cited

U.S. PATENT DOCUMENTS

| | | | | |
|---|---|---|---|---|
| 4,508,075 | A * | 4/1985 | Takao et al. | 123/480 |
| 6,557,530 | B1 * | 5/2003 | Benson et al. | 123/480 |
| 6,694,945 | B2 * | 2/2004 | Kawaguchi et al. | 123/436 |
| 6,755,176 | B2 * | 6/2004 | Takeuchi et al. | 123/436 |
| 6,907,861 | B2 * | 6/2005 | Asano et al. | 123/436 |
| 2004/0267433 | A1 | 12/2004 | Asano | 701/104 |

* cited by examiner

*Primary Examiner*—Tony M. Argenbright
(74) *Attorney, Agent, or Firm*—Nixon & Vanderhye P.C.

(57) ABSTRACT

An electronic control unit (ECU) of an injection control system of an internal combustion engine determines that a load of a fuel pump is stabilized when a pressure-feeding operation delay elapses since a command pressure-feeding quantity outputted to the fuel pump reaches a certain pressure-feeding quantity necessary to maintain a target injection pressure. The ECU permits a single injection when a waiting period necessary to measure rotation speeds once for each cylinder before the single injection is performed elapses since the load of the fuel pump is stabilized. Thus, the single injection timing is determined based on the time point when the command pressure-feeding quantity is stabilized, the pressure-feeding operation delay, and the waiting period. Therefore, an injection quantity learning operation can be performed highly accurately in a short period.

8 Claims, 4 Drawing Sheets

INJECTION CONTROL SYSTEM OF DIESEL ENGINE

CROSS REFERENCE TO RELATED APPLICATION

This application is based on and incorporates herein by reference Japanese Patent Application No. 2003-378664 filed on Nov. 7, 2003.

BACKGROUND OF THE INVENTION

1. Field of the Invention

The present invention relates to an injection control system of a diesel engine for performing an injection quantity learning operation.

2. Description of Related Art

As a method of inhibiting combustion noise or generation of nitrogen oxides in a diesel engine, a method of performing a pilot injection for injecting a very small quantity of fuel before a main injection is known. Since a command value of the pilot injection quantity is small, improvement of injection accuracy is necessary to sufficiently exert the effect of the pilot injection of inhibiting the combustion noise and the generation of the nitrogen oxides. Therefore, an injection quantity learning operation for measuring a deviation between the command injection quantity of the pilot injection and a quantity of actually injected fuel (an actual injection quantity) and for correcting the injection quantity on a software side is necessary.

A fuel injection control system described in Japanese Patent Application No. 2003-185633 can perform the injection quantity learning operation highly accurately. The control system controls an injection pressure (a pressure of fuel in a common rail) to a target injection pressure for the learning operation while an operating state of the engine is in a deceleration-and-fuel-cutting state (a state in which fuel supply is cut and a vehicle is decelerated). Then, the control system performs a single injection for the learning operation from an injector into a specific cylinder. The control system learns (corrects) the injection quantity based on a fluctuation of an engine rotation speed caused by the single injection.

Timing for performing the single injection is an important factor to realize highly accurate correction in the injection quantity learning operation. More specifically, if the timing of the single injection is too early, there is a possibility that a condition suitable for measuring the rotation speed fluctuation caused by the single injection has not been established yet. For instance, if the single injection is performed at too early timing at which a load of the fuel pump is still unstable and is causing a rotation speed fluctuation, a learned value of the injection quantity will include an error. If the timing of the single injection is too late, a period necessary to accomplish the learning operation is lengthened. In this case, there is a possibility that the learning condition is broken if the injection is resumed when a vehicle driver accelerates a vehicle again or if the injection is resumed to prevent engine stall when the rotation speed decreases to proximity of an idling rotation speed, for instance. In such a case, the learning operation cannot be completed. Thus, determination of suitable single injection timing is important.

As explained above, in this injection quantity learning operation, the step of decelerating the vehicle and cutting the fuel supply, the step of controlling (increasing or decreasing) the injection pressure to the target injection pressure, the step of injecting the fuel into the specific cylinder, and the step of measuring the rotation speed fluctuation caused by the single injection are performed in that order. The engine drives the fuel pump. Accordingly, if the load of the fuel pump increases, or if a quantity of the fuel pressure-fed by the fuel pump increases, the load of the fuel pump affects the engine rotation speed (for instance, the engine rotation speed decreases). Moreover, the load of the fuel pump affects the rotation speed fluctuation caused by the single injection. Therefore, the single injection is performed in the specific cylinder under a condition that the injection pressure is controlled to the target injection pressure and the rotation speed fluctuation caused by the pump load fluctuation due to the injection pressure control subsides. It is required that the load of the fuel pump should be stable (or the load of the fuel pump should not fluctuate greatly) while the rotation speed fluctuation caused by the single injection is measured.

The load of the fuel pump is associated with a fuel pressure-feeding quantity of the fuel pump. An electronic control unit (ECU) determines the fuel pressure-feeding quantity based on at least the target injection pressure and the present injection pressure. Therefore, the load of the fuel pump can be estimated based on a command pressure-feeding quantity outputted to the fuel pump. It can be determined that the load of the fuel pump is stabilized if the command pressure-feeding quantity outputted to the fuel pump does not fluctuate for a predetermined period. However, in this case, there is a possibility that the single injection timing is delayed.

SUMMARY OF THE INVENTION

It is therefore an object of the present invention to provide an injection control system of a diesel engine capable of determining optimum timing of a single injection for an injection quantity learning operation.

According to an aspect of the present invention, an injection control system of a diesel engine includes load determining means for determining whether a load of a fuel pump is stabilized after a learning condition is established and a pressure of fuel accumulated in a common rail (an injection pressure) is controlled to a target injection pressure. The injection control system performs a single injection from an injector into a specific cylinder of the engine if the single injection is permitted after the load determining means determines that the load of the fuel pump is stabilized.

In the above structure, the single injection is performed in a state in which the load of the fuel pump is stabilized after the injection pressure is controlled to the target injection pressure. Therefore, the single injection is not performed at too early timing. Thus, when the injection quantity is learned based on a rotation speed fluctuation caused by the single injection, influence of a fluctuation of the load of the fuel pump, which can cause an error, can be inhibited.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENTS

First Embodiment

Figure 1:
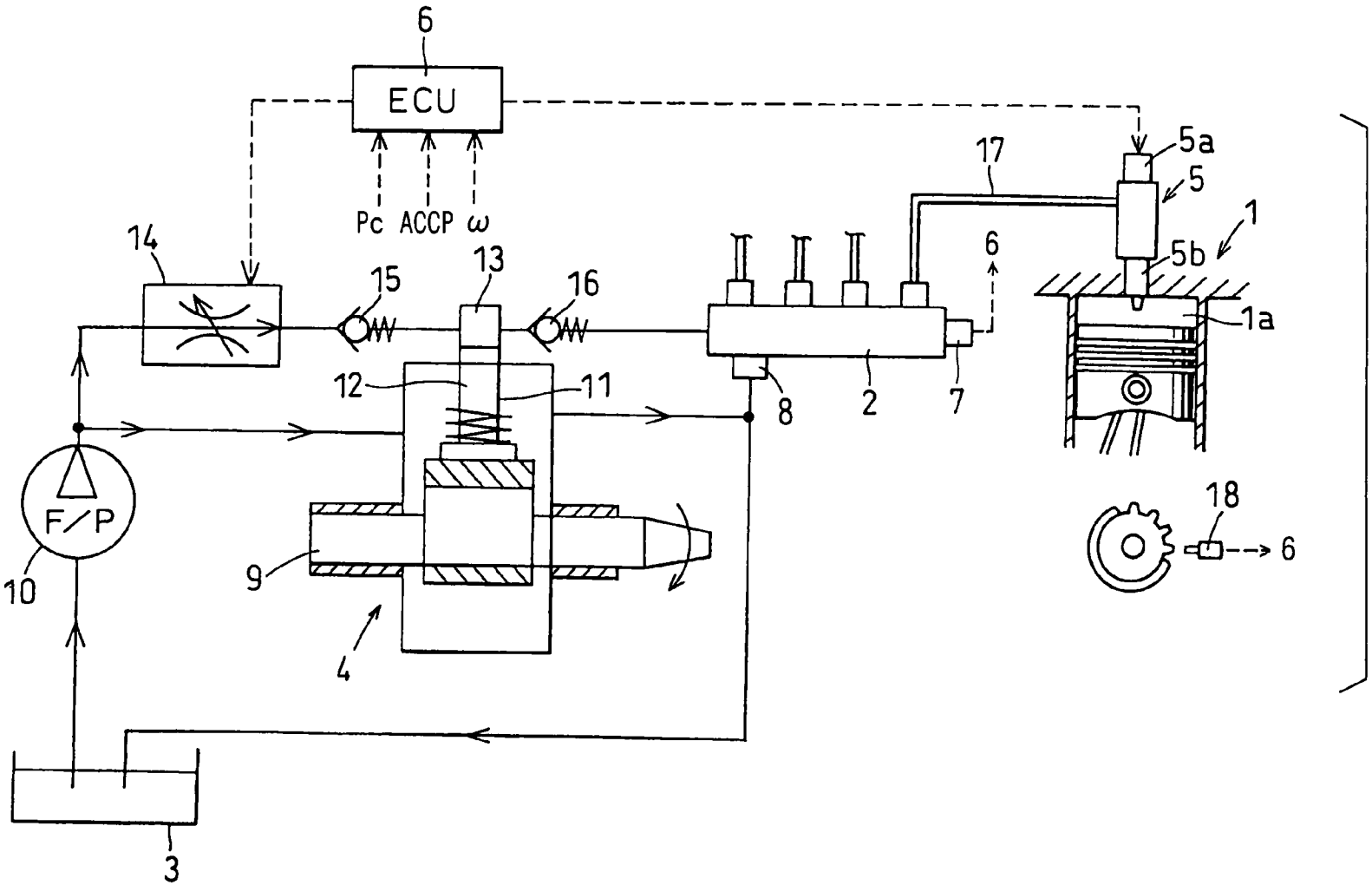
FIG. 1 is a schematic diagram showing a control system of a diesel engine according to a first embodiment of the present invention.

Referring to FIG. 1, a control system of a four-cylinder diesel engine 1 according to a first embodiment of the present invention is illustrated. As shown in FIG. 1, the engine 1 of the present embodiment includes an accumulation type fuel injection system and an electronic control unit (ECU) 6 for electronically controlling the fuel injection system.

As shown in FIG. 1, the fuel injection system includes a common rail 2, a fuel pump 4 and injectors 5. The common rail 2 accumulates high-pressure fuel. The fuel pump 4 pressurizes fuel drawn from a fuel tank 3 and pressure-feeds the fuel to the common rail 2. The injectors 5 supply the high-pressure fuel, which is supplied from the common rail 2, into cylinders (combustion chambers 1*a*) of the engine 1.

The ECU 6 sets a target value of a rail pressure Pc of the common rail 2 (a pressure of the fuel accumulated in the common rail 2). The rail pressure Pc corresponds to a fuel injection pressure. The common rail 2 accumulates the high-pressure fuel, which is supplied from the fuel pump 4, to the target value of the rail pressure Pc. A pressure sensor 7 and a pressure limiter 8 are attached to the common rail 2. The pressure sensor 7 senses the rail pressure Pc and outputs the rail pressure Pc to the ECU 6. The pressure limiter 8 limits the rail pressure Pc so that the rail pressure Pc does not exceed a predetermined upper limit value.

The fuel pump 4 has a camshaft 9, a feed pump 10, a plunger 12 and an electromagnetic flow control value 14. The camshaft 9 is driven and rotated by the engine 1. The feed pump 10 is driven by the camshaft 9 and draws the fuel from the fuel tank 3. The plunger 12 reciprocates in a cylinder 11 in synchronization with the rotation of the camshaft 9. The electromagnetic flow control valve 14 regulates a quantity of the fuel introduced from the feed pump 10 into a pressurizing chamber 13 provided inside the cylinder 11.

In the fuel pump 4, when the plunger 12 moves from a top dead center to a bottom dead center in the cylinder 11, the quantity of the fuel discharged from the feed pump 10 is regulated by the electromagnetic flow control valve 14, and the fuel opens a suction valve 15 and is drawn into the pressurizing chamber 13. Then, when the plunger 12 moves from the bottom dead center to the top dead center in the cylinder 11, the plunger 12 pressurizes the fuel in the pressurizing chamber 13. Thus, the fuel opens a discharge valve 16 from the pressurizing chamber 13 side and is pressure-fed to the common rail 2.

The injectors 5 are mounted to the respective cylinders of the engine 1 and are connected to the common rail 2 through high-pressure pipes 17. Each injector 5 has an electromagnetic valve 5*a*, which operates responsive to a command outputted from the ECU 6, and a nozzle 5*b*, which injects the fuel when the electromagnetic valve 5*a* is energized.

The electromagnetic valve 5*a* opens and closes a low-pressure passage leading from a pressure chamber, into which the high-pressure fuel in the common rail 2 is supplied, to a low-pressure side. The electromagnetic valve 5*a* opens the low-pressure passage when energized, and closes the low-pressure passage when deenergized.

The nozzle 5*b* incorporates a needle for opening or closing an injection hole. The pressure of the fuel in the pressure chamber biases the needle in a valve closing direction (a direction for closing the injection hole). If the electromagnetic valve 5*a* is energized and opens the low-pressure passage, the fuel pressure in the pressure chamber decreases. Accordingly, the needle ascends in the nozzle 5*b* and opens the injection hole. Thus, the nozzle 5*b* injects the high-pressure fuel, which is supplied from the common rail 2, through the injection hole. If the electromagnetic valve 5*a* is deenergized and closes the low-pressure passage, the fuel pressure in the pressure chamber increases. Accordingly, the needle descends in the nozzle 5*b* and closes the injection hole. Thus, the injection is ended.

The ECU 6 is connected with a rotation speed sensor 18 for sensing an engine rotation speed (a rotation number of the engine 1 per minute) ω, an accelerator position sensor for sensing an accelerator position (a load of the engine 1) ACCP and the pressure sensor 7 for sensing the rail pressure Pc. The ECU 6 calculates the target value of the rail pressure Pc of the common rail 2, and injection timing and an injection quantity suitable for the operating state of the engine 1 based on the information sensed by the above sensors. The ECU 6 electronically controls the electromagnetic flow control valve 14 of the fuel pump 4 and the electromagnetic valves 5*a* of the injectors 5 based on the results of the calculation.

In order to improve accuracy of a minute quantity injection such as a pilot injection performed before a main injection, the ECU 6 performs an injection quantity learning operation explained below.

In the injection quantity learning operation, an error between a command injection quantity Qi corresponding to the pilot injection and a quantity (an actual injection quantity) of the fuel actually injected by the injector 5 responsive to the command injection quantity Qi (or an injection command pulse) is measured. Then, the command injection quantity Qi is corrected in accordance with the error.

Figure 2:
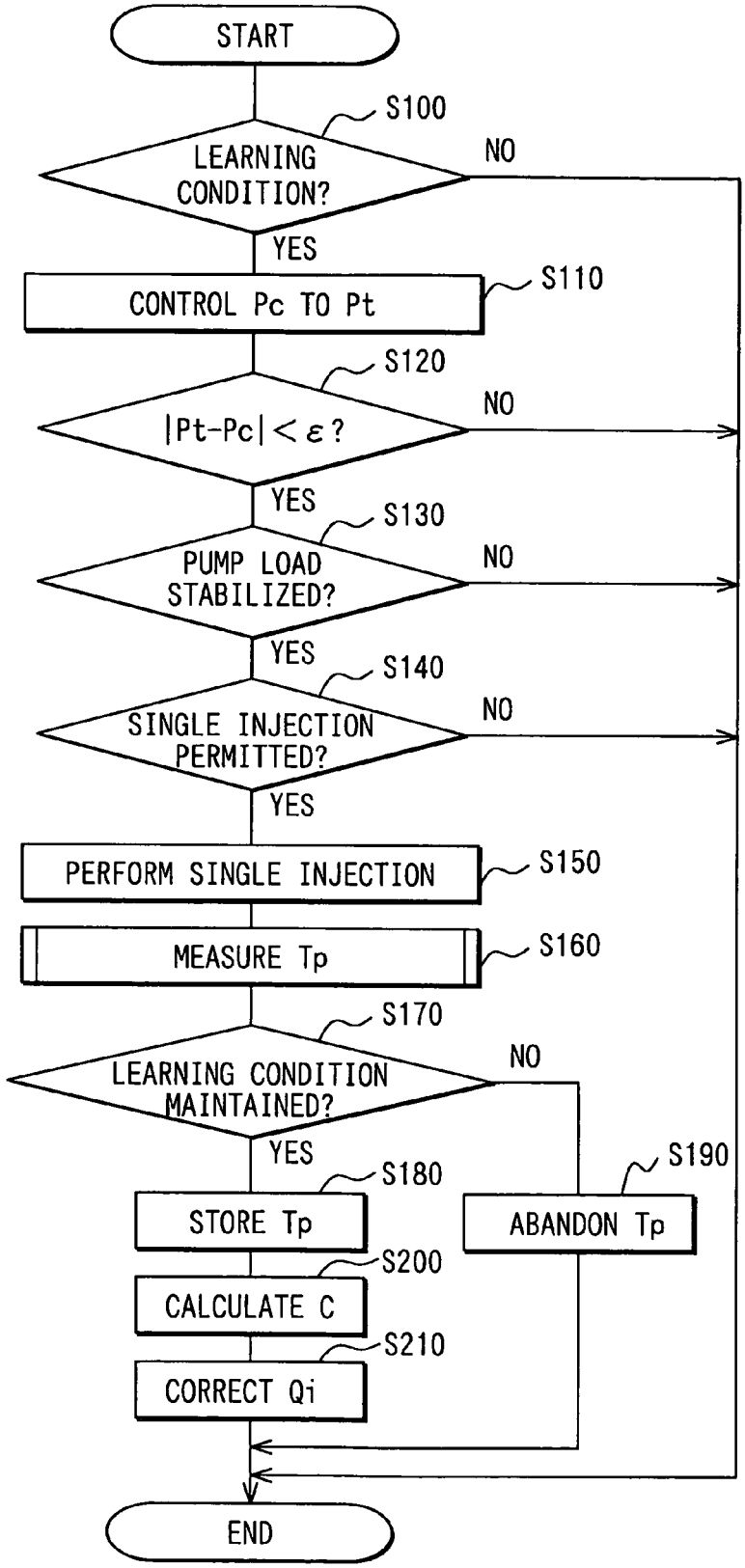
FIG. 2 is a flowchart showing processing steps of an injection quantity learning operation performed by an ECU of the control system according to the first embodiment.

Next, processing steps of the injection quantity learning operation performed by the ECU 6 will be explained based on a flowchart shown in FIG. 2.

First, in Step S100, it is determined whether a learning condition for performing the injection quantity learning operation is established. The learning condition is established at least when the engine 1 is in a no-injection state, in which the command injection quantity Qi (shown by a solid line "a" in FIG. 4) outputted to the injector 5 is zero or under. The engine 1 is brought to the no-injection state if the fuel supply is cut when a position of a shift lever is changed or when a vehicle is decelerated, for instance. If the result of the determination in Step S100 is "YES", the processing proceeds to Step S110. If the result of the determination in Step S100 is "NO", the processing is ended.

Figure 4:
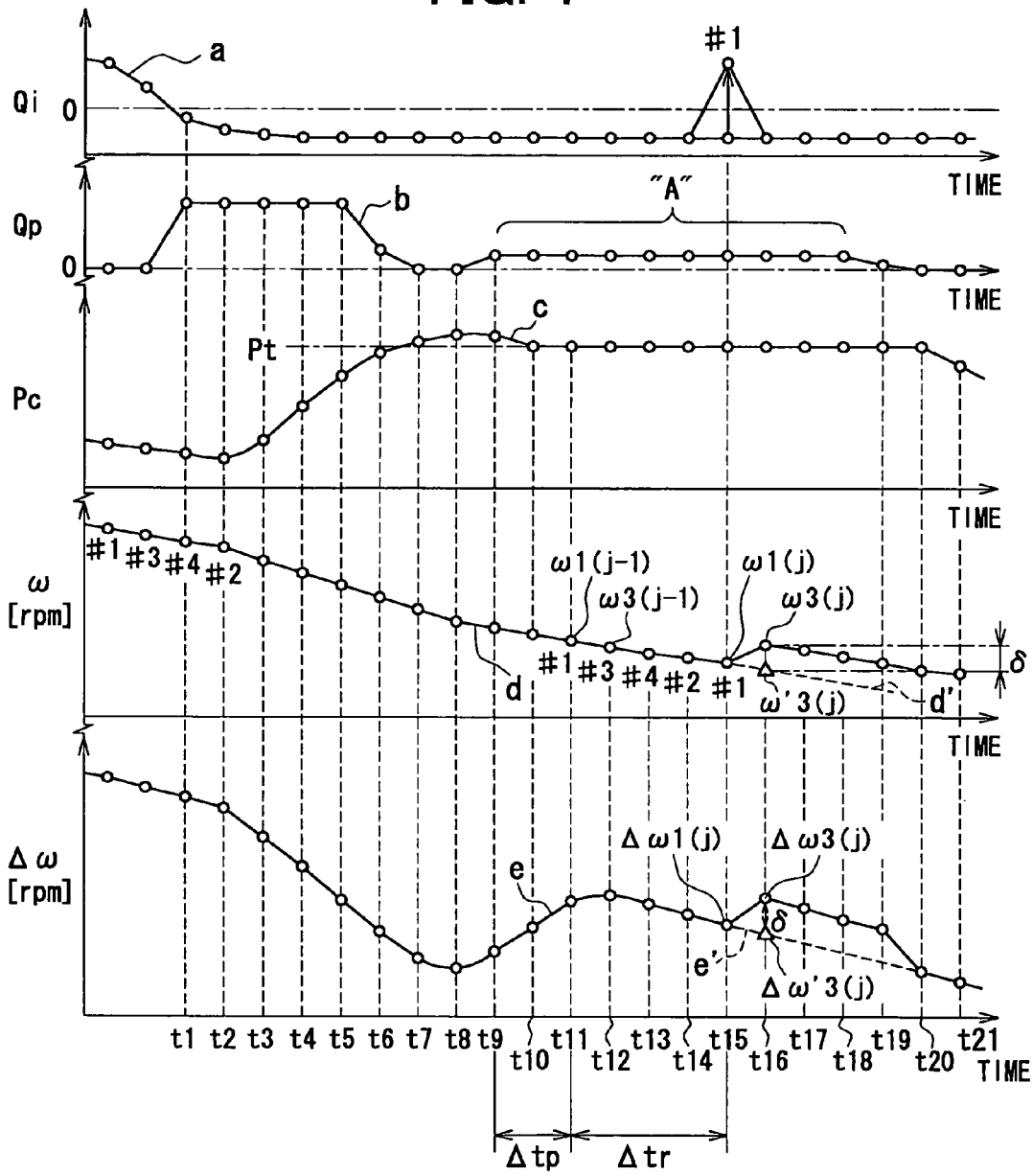
FIG. 4 is a time chart showing the injection quantity learning operation performed by the ECU according to the first embodiment or an ECU according to a second embodiment of the present invention.

In Step S110, the rail pressure (the injection pressure) Pc of the common rail 2 is controlled to a target injection pressure Pt for the injection quantity learning operation as shown by a solid line "c" in FIG. 4. The target injection pressure Pt is different from the target value of the rail pressure Pc for normal control.

More specifically, at a time point t1 of FIG. 4, at which the command injection quantity Qi becomes zero or under as shown by the solid line "a", a command pressure-feeding quantity Qp calculated from the target injection pressure Pt and the present injection pressure Pc is outputted to the fuel pump 4 as shown by a solid line "b". The fuel pump 4 pressure-feeds the fuel to the common rail 2 once while the two injections are performed. In the case of the four-cylinder engine 1, the fuel pump 4 pressure-feeds the fuel once while the engine makes one revolution and performs two injections.

Therefore, if the command pressure-feeding quantity Qp is outputted to the fuel pump 4 at time points t1, t2 in FIG. 4, the fuel pump 4 draws the quantity Qp of the fuel in a period from the time point t1 to a time point t3 and pressure-feeds the fuel in a period from the time point t3 to a time point t5. Thus, there is a delay corresponding to one revolution of the engine 1 between the time point when the command pressure-feeding quantity Qp is outputted to the fuel pump 4 and the time point when the quantity Qp of the fuel is pressure-fed. The delay corresponding to one revolution is referred to as a pressure-feeding operation delay Δtp, hereafter.

The command pressure-feeding quantity Qp is outputted to the fuel pump 4 and the engine rotation speed ω is measured every time the engine 1 makes a half turn. Therefore, each interval between adjacent two time points t(i), t(i+1) among time points t1–t21 shown in FIG. 4 corresponds to the half turn of the engine 1.

If the fuel pump 4 actually pressure-feeds the fuel, the load applied to the engine 1 by the fuel pump 4 increases. Therefore, in such a case, the decrease in the engine rotation speed ω or a rotation speed change Δω (explained after) is promoted as shown by a solid line "d" or a solid line "e" in FIG. 4, and this tendency continues until a time point t8, at which the influence of the large command pressure-feeding quantity Qp at the time points t5, t6 emerges. Then, fine adjustment of the injection pressure Pc is performed based on the command pressure-feeding quantity Qp outputted at the time points t7, t8. In the present embodiment, a pressure-reducing command is outputted to reduce the pressure-feeding quantity, since the injection pressure Pc has exceeded the target injection pressure Pt. Thus, after a time point t9, the command pressure-feeding quantity Qp is stabilized as shown in a period "A" in FIG. 4. The pressure-feeding quantity Qp in the stable period "A" is determined based on the target value of the injection pressure Pc and engine characteristics such as a quantity of the fuel leaking from the injectors 5 when the engine 1 is in the no-injection state.

In Step S120, it is determined whether a difference between the actual injection pressure Pc and the target injection pressure Pt is less than a predetermined constant value ϵ. More specifically, it is determined whether the actual injection pressure Pc substantially reaches the target injection pressure Pt. If the result of the determination in Step S120 is "YES", the processing proceeds to Step S130. If the result of the determination in Step S120 is "NO", the processing is ended. The pressure sensor 7 senses the actual injection pressure Pc.

In Step S130, it is determined whether the load of the fuel pump 4 is stabilized. In this step, it is determined that the load of the fuel pump 4 is stabilized when the pressure-feeding operation delay Δtp elapses since the command pressure-feeding quantity Qp outputted to the fuel pump 4 is stabilized, or when a time point t11 in FIG. 4 is reached. In the fuel pump 4 of the present embodiment, there is a delay corresponding to one revolution of the engine 1 from the time point when the command pressure-feeding quantity Qp is outputted to the fuel pump 4 to the time point when the quantity Qp of the fuel is actually pressure-fed. The command pressure-feeding quantity Qp outputted to the fuel pump 4 is stabilized at the time point t9, and then, the stabilization of the command pressure-feeding quantity Qp is reflected in the rotation speed ω after the time point t11 as shown in FIG. 4. Therefore, it is determined that the load of the fuel pump 4 is stabilized when the pressure-feeding operation delay Δtp elapses since the command pressure-feeding quantity Qp outputted to the fuel pump 4 is stabilized. If the result of the determination in Step S130 is "YES", the processing proceeds to Step S140. If the result of the determination in Step S130 is "NO", the processing is ended.

In Step S140, it is determined whether the single injection in the specific cylinder for the injection quantity learning operation is permitted or not based on a waiting period Δtr. The waiting period Δtr is a period corresponding to two revolutions of the engine 1 necessary to measure the rotation speed ω once for each cylinder before the single injection is performed while the load of the fuel pump 4 is stable as shown in FIG. 4. More specifically, the single injection is permitted when a time point t15 is reached, or when the waiting period Δtr elapses since the time point t11 when it is determined that the load of the fuel pump 4 is stabilized. If the result of the determination in Step S140 is "YES", the processing proceeds to Step S150. If the result of the determination in Step S140 is "NO", the processing is ended.

In Step S150, the single injection is performed in the specific cylinder (the first cylinder #1, in the present embodiment) of the engine 1 at the time point t15 as shown by the solid line "a" in FIG. 4. The single injection is performed at a time point immediately before a top dead center (TDC) of the specific cylinder so that the fuel is ignited at a time point near the TDC. The quantity of the fuel injected in the single injection corresponds to a fuel quantity of a pilot injection.

In Step S160, a characteristic value (a torque proportional value) Tp proportional to engine torque T generated by performing the single injection is measured.

Then, in Step S170, it is determined whether the processing of the steps from Step S110 to Step S160 is performed under the aimed learning condition presented in Step S100. In this step, it is determined whether the learning condition presented in Step S100 has been maintained without resuming the injection or changing the rail pressure Pc while the characteristic value Tp is measured. If the result of the determination in Step S170 is "YES", the processing proceeds to Step S180. If the result of the determination in Step S170 is "NO", the processing proceeds to Step S190.

In Step S180, the characteristic value Tp measured in Step S160 is stored in a memory.

In Step S190, the characteristic value Tp measured in Step S160 is abandoned and the processing is ended.

In Step S200, a correction value C is calculated from the characteristic value Tp stored in Step S180.

More specifically, a target value of the characteristic value Tp is calculated from the command injection quantity Qi corresponding to the single injection. Then, the correction value C is calculated in accordance with a deviation between the target value and the actually measured characteristic value Tp. Alternatively, a quantity (an actual injection quantity) of the fuel actually injected in the single injection is calculated based on the actually measured characteristic value Tp. Then, the correction value C is calculated in accordance with a deviation between the actual injection quantity and the command injection quantity Qi. Alternatively, the correction value C is calculated in accordance with a difference between injection pulse width corresponding to the actual injection quantity and injection pulse width corresponding to the command injection quantity Qi.

In Step S210, the command injection quantity Qi outputted to the injector 5 is corrected in accordance with the correction value C calculated in Step S200.

Figure 3:
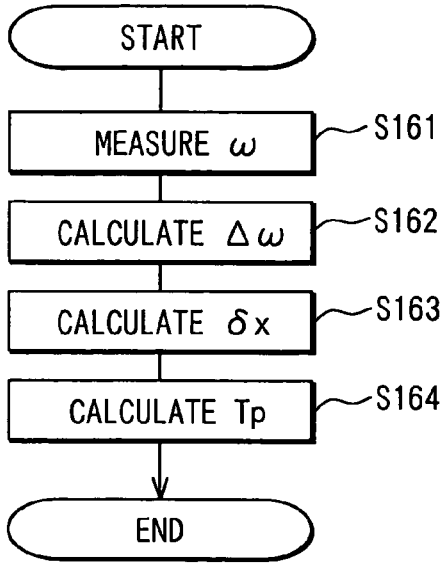
FIG. 3 is a flowchart showing processing steps for measuring a torque proportional value performed by the ECU according to the first embodiment.

Next, a method of measuring the characteristic value (the torque proportional value) Tp performed in Step S160 will be explained based on a flowchart shown in FIG. 3.

First, in Step S161, the signal of the rotation speed sensor 18 is inputted and the engine rotation speed ω is measured. The four-cylinder engine 1 of the present embodiment performs the injections in the first cylinder #1, in the third cylinder #3, in the fourth cylinder #4 and in the second cylinder #2 in that order. The engine rotation speed ω is measured four times (once for each cylinder) while a crankshaft rotates twice through a crank angle of 720° (720° CA). Thus, the rotation speed ω1(j), the rotation speed ω3(j), the rotation speed ω4(j), and the rotation speed ω2(j) corresponding to the respective cylinders #1, #3, #4, #2 are measured in that order while the crankshaft rotates twice.

Figure 5:
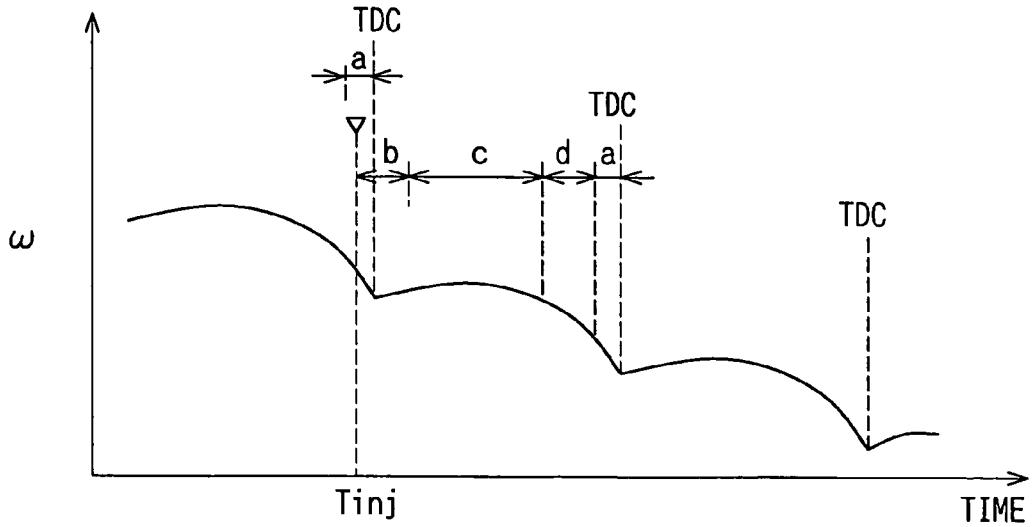
FIG. 5 is a time chart showing timing for measuring a rotation speed of the engine according to the first embodiment.

The engine rotation speed ω is measured immediately before the injection timing Tinj of the injector 5. The injection timing Tinj is set in a period "a" shown in FIG. 5. More specifically, the timing for measuring the rotation speed ω is set in a period "d" shown in FIG. 5, which is posterior to an ignition delay "b" and a combustion period "c". The ignition delay "b" is a period from a time point when the fuel is injected to a time point when the injected fuel is ignited. The combustion period "c" is a period in which the fuel is actually combusted. The engine rotation speed ω shown by the solid line "d" in FIG. 4 is an average of the rotation speeds measured during the rotation speed measuring period "d" shown in FIG. 5.

Then, in Step S162, the rotation speed change Δω is calculated for each cylinder. For instance, in the case of the third cylinder #3, a difference Δω3 between the rotation speed ω3(j-1) and the next rotation speed ω3(j) corresponding to the third cylinder #3 is calculated as the rotation speed change Δω. The rotation speed change Δω monotonically decreases when the engine 1 is in the no-injection state as shown by a solid line "e" in FIG. 4. However, the rotation speed change Δω increases once for each cylinder as shown by the solid line "e" in FIG. 4 immediately after the single injection is performed.

Then, in Step S163, rotation speed increases δ of the respective cylinders caused by the single injection are calculated, and an average δ× of the rotation speed increases δ is calculated. A difference between the rotation speed change Δω calculated in Step S162 and an estimated rotation speed change Δω' (shown by a broken line "e'" in FIG. 4) in the case where the single injection is not performed is calculated as the rotation speed increase δ. The rotation speed change Δω decreases monotonically when the single injection is not performed. Therefore, the rotation speed change Δω' in the case where the single injection is not performed can be easily estimated from the rotation speed change Δω provided before the single injection or the rotation speed changes Δω provided before and after the single injection.

Then, in Step S164, the torque proportional value Tp is calculated by multiplying the average δ× calculated in Step S163 by the engine rotation speed ω1(j) at the time when the single injection is performed. The torque proportional value Tp is proportional to the torque T of the engine 1 generated by the single injection. The torque T generated by the engine 1 is calculated based on a following equation (1). Therefore, the torque proportional value Tp, which is the product of the average δ× and the rotation speed ω1(j) is proportional to the torque T. In the equation (1), K represents a proportionality factor.

$$T=K\cdot\delta\times\cdot\omega\mathbf{1}(j), \tag{1}$$

In the injection quantity learning operation of the present embodiment, it is determined that the load of the fuel pump 4 is stabilized when the time point t11 in FIG. 4 is reached, or when the pressure-feeding operation delay Δtp of the fuel pump 4 elapses since the time point t9 in FIG. 4 when the command pressure-feeding quantity Qp outputted to the fuel pump 4 reaches a certain pressure-feeding quantity necessary to maintain the target injection pressure Pt. In the present embodiment, the pressure-feeding operation delay Δtp corresponds to one revolution of the engine 1. More specifically, it is determined whether the load of the fuel pump 4 is stabilized or not based on the period (the pressure-feeding operation delay Δtp) from the time point when the command pressure-feeding quantity Qp outputted to the fuel pump 4 is stabilized to the time point when the fluctuation of the load of the fuel pump 4 subsides. Thus, the stabilization of the load of the fuel pump 4 can be determined more appropriately.

In the injection quantity learning operation of the present embodiment, it is determined whether the single injection is permitted or not based on the waiting period Δtr. The waiting period Δtr is a period corresponding to two revolutions of the engine 1 necessary to measure the rotation speeds ω, from which the characteristic value Tp is calculated, for each cylinder after the load of the fuel pump 4 is stabilized and before the single injection is performed. More specifically, the single injection is permitted when the time point t15 is reached, or when the waiting period Δtr elapses since the time point t11 when it is determined that the load of the fuel pump 4 is stabilized. Therefore, the timing of the single injection is neither too early nor too late. Thus, the single injection timing suitable for the injection quantity learning operation can be determined.

As explained above, the single injection timing is determined based on the time point t9 when the command pressure-feeding quantity Qp outputted to the fuel pump 4 is stabilized, the pressure-feeding operation delay Δtp of the fuel pump 4, and the waiting period Δtr necessary to measure the rotation speeds ω before the single injection is performed. Therefore, the injection quantity learning operation can be performed highly accurately in a very short period. The measurement of the rotation speed ω necessary to measure the rotation speed increase δ is finished at a time point t20. Therefore, the fluctuation of the load of the fuel pump 4 is allowed from the time point t21. Therefore, in order to decrease the injection pressure Pc to the target value of the rail pressure Pc of the normal control after the time point t21, the target injection pressure Pt is switched to the value for the normal control at a time point t19, which is prior to the time point t21 by one revolution of the engine 1 corresponding to the pressure-feeding operation delay Δtp of the fuel pump 4. Thus, the pressure reducing command is outputted to the fuel pump 4 to decrease the fuel pressure-feeding quantity in accordance with the target value of the rail pressure Pc of the normal control.

Second Embodiment

Next, a method of calculating the rotation speed increase δ performed by an ECU 6 according to a second embodiment of the present invention will be explained.

In the second embodiment, a difference between the engine rotation speed ω increased by performing the single injection and the engine rotation speed ω' in the case where the single injection is not performed is calculated as the rotation speed increase δ. The crank angle corresponding to the engine rotation speed ω' is the same as the crank angle at which the engine rotation speed ω is measured. The engine rotation speed ω' in the case where the single injection is not performed shown by a broken line "d'" in FIG. 4 can be easily estimated from the engine rotation speed ω provided before the single injection.

In this case, if the load of the fuel pump 4 is actually stabilized at the time point t11, the single injection can be performed at a time point t12 and the rotation speed increase δ can be measured at a time point t13. It is because the rotation speed ω at the time point t13 in the case where the single injection is not performed can be estimated from the rotation speeds ω at the time points t11, t12. Therefore, in the second embodiment, the rotation speed increase δ can be calculated by measuring the rotation speed ω corresponding to only one cylinder after the load of the fuel pump 4 is stabilized until the single injection is performed. Therefore, the waiting period Δtr necessary to measure the rotation speed ω before the single injection is performed corresponds to a half turn of the engine 1. As a result, the waiting period Δtr can be shortened compared to the waiting period Δtr of the first embodiment. Thus, the injection quantity learning operation can be finished in a shorter period.

Modifications

The rotation speed increase δ may be calculated by comparing an instantaneous rotation speed provided at the TDC with another instantaneous rotation speed provided at the 90° CA after the TDC. Thus, the measurement of the rotation speed increase δ can be finished in one cylinder. Therefore, the waiting period Δtr necessary to measure the rotation speed ω before the single injection can be eliminated. In this method, the single injection can be performed immediately if it is determined that the load of the fuel pump 4 is stabilized. Therefore, the period necessary to perform the injection quantity learning operation can be shortened further.

In the first embodiment, the fuel pump 4 performs one pressure-feeding operation while two injections are performed. Alternatively, a fuel pump 4, which performs one pressure-feeding operation while one injection is performed, may be employed. In this case, the pressure-feeding operation delay Δtp of the fuel pump 4 corresponds to a half turn of the engine 1. Therefore, it can be determined that the load of the fuel pump 4 is stabilized when the half turn is made (at a time point t10) since the command pressure-feeding quantity Qp outputted to the fuel pump 4 is stabilized at the time point t9. Also in this case, the period necessary to perform the injection quantity learning operation can be shortened since the pressure-feeding operation delay Δtp of the fuel pump 4 is shortened.

In the first embodiment, the injection quantity learning operation of the pilot injection is performed. Alternatively, the present invention may be applied to an injection quantity learning operation of any one of a normal injection (an injection performed only once in one combustion cycle of a cylinder) without performing the pilot injection, a main injection performed after the pilot injection, or an after injection performed after the main injection.

The present invention should not be limited to the disclosed embodiments, but may be implemented in many other ways without departing from the spirit of the invention.

What is claimed is:

1. An injection control system of a diesel engine having a common rail for accumulating fuel, which is pressure-fed by a fuel pump, and injectors for injecting the high-pressure fuel, which is supplied from the common rail, into combustion chambers of cylinders of the engine, the injection control system comprising:

condition determining means for determining whether a learning condition for performing an injection quantity learning operation is established;

pump commanding means for commanding the fuel pump to discharge a command pressure-feeding quantity of the fuel to control a pressure of the fuel accumulated in the common rail to a target injection pressure after the learning condition is established;

load determining means for determining whether a load of the fuel pump is stabilized after the pressure of the fuel is controlled to the target injection pressure;

permission determining means for determining whether a single injection in a specific cylinder of the engine for performing the injection quantity learning operation is permitted after it is determined that the load of the fuel pump is stabilized;

injector commanding means for commanding the injector to perform the single injection if the single injection is permitted;

measuring means for measuring a fluctuation of a rotation speed of the engine caused by performing the single injection;

calculating means for calculating a correction value based on the fluctuation of the rotation speed; and correcting means for correcting a command injection quantity, which is outputted to the injector, in accordance with the correction value.

2. The injection control system as in claim 1, wherein the load determining means determines that the load of the fuel pump is stabilized at least when the command pressure-feeding quantity outputted to the fuel pump reaches a certain pressure-feeding quantity necessary to maintain the target injection pressure.

3. The injection control system as in claim 2, wherein the load determining means determines that the load of the fuel pump is stabilized if a pressure-feeding operation delay elapses since the command pressure-feeding quantity outputted to the fuel pump reaches the certain pressure-feeding quantity necessary to maintain the target injection pressure, wherein the pressure-feeding operation delay is a period from a time point when the command pressure-feeding quantity is outputted to the fuel pump to a time point when the fuel pump actually draws and pressure-feeds the fuel corresponding to the command pressure-feeding quantity.

4. The injection control system as in claim 1, wherein the permission determining means permits the single injection if a waiting period elapses since the load of the fuel pump is stabilized, wherein the waiting period is a period necessary to measure the rotation speed of the engine before the single injection is performed after the load of the fuel pump is stabilized.

5. The injection control system as in claim 1, wherein the calculating means calculates a target value of the fluctuation of the rotation speed from a command injection quantity corresponding to the single injection and calculates the correction value in accordance with a difference between the target value and the fluctuation of the rotation speed measured by the measuring means.

6. The injection control system as in claim 1, wherein the calculating means calculates an actual injection quantity of the fuel actually injected in the single injection based on the fluctuation of the rotation speed measured by the measuring means, and calculates the correction value in accordance with a difference between the actual injection quantity and a command injection quantity corresponding to the single injection.

7. The injection control system as in claim 6, wherein the calculating means calculates the correction value in accordance with a difference between injection pulse width corresponding to the actual injection quantity and injection pulse width corresponding to the command injection quantity.

8. The injection control system as in claim 1, wherein the learning condition is established at least when the engine is in a no-injection state, in which the command injection quantity outputted to the injector is zero or under.

* * * * *